United States Patent [19]

Tadauchi et al.

[11] 4,414,551

[45] Nov. 8, 1983

[54] POWER ANTENNA CONTROL CIRCUIT USED IN VEHICLE

[75] Inventors: Kazuhiro Tadauchi, Toyota; Taketsugu Torii, Kasugai, both of Japan

[73] Assignee: Toyota Jidosha Kogyo Kabushiki Kaisha, Toyota, Japan

[21] Appl. No.: 280,214

[22] Filed: Jul. 6, 1981

[30] Foreign Application Priority Data

Jul. 7, 1980 [JP] Japan ..... 55-95395[U]

[51] Int. Cl.[3] ..... H01Q 1/32

[52] U.S. Cl. ..... 343/903; 318/266

[58] Field of Search ..... 318/266, 267, 467, 468; 343/903

[56] References Cited

U.S. PATENT DOCUMENTS 2,933,597 4/1960 Jensen ..... 343/903

4,198,637 4/1980 Sand ..... 343/903

4,338,552 7/1982 Pilz et al. ..... 318/266

*Primary Examiner*—Eli Lieberman

*Attorney, Agent, or Firm*—Parkhurst & Oliff

[57] ABSTRACT

A power antenna control circuit used in a vehicle wherein a relay coil is connected to a battery through a transistor and a limit switch at the antenna lowering side and a circuit for rotating a motor by a relay switch. The transistor is turned off when an ignition switch is turned on and turned on when the ignition switch is turned off. While the ignition switch is on, the relay coil is not excited, thus enabling to reduce the electricity consumption of the battery. When the ignition is turned on, the relay coil is excited to form a circuit for rotating the motor in a direction of lowering the antenna, and, when the lowering of the antenna is completed, supply of the current to the motor and the relay coil is interrupted through the agency of the limit switch at the antenna lowering side.

5 Claims, 2 Drawing Figures

POWER ANTENNA CONTROL CIRCUIT USED IN VEHICLE

BACKGROUND OF THE INVENTION

1. Field of the Invention

This invention relates to an electric circuit for controlling vertical movement of a pole antenna provided on a vehicle body as an antenna for a vehicle-mounted radio receiver.

2. Description of the Prior Art

The pole antenna of the type described is preferably of such an arrangement that a control circuit is formed to vertically move the antenna whenever necessary and the antenna is lowered and housed in a vehicle body when the vehicle is stopped, so that breaking of the pole antenna out of fun during the stop of the vehicle can be avoided and the antenna can stay out of the way of people or objects being therearound.

Heretofore, there has been proposed a circuit shown in FIG. 1 as a circuit to satisfy the requirements as described above. Description will hereunder be given of the proposed circuit with reference to FIG. 1.

A contact 43 of a switch 4 for raising the antenna and a contact 53 of a switch 5 for lowering the antenna are connected to a positive pole of a power source 1. Further, a contact 42 of the switch 4 for raising the antenna is connected to a negative pole of the power source 1 through a limit switch 9 at the raising side and a contact 52 of the switch 5 for lowering the antenna is also connected to the negative pole of the power source 1 through a limit switch 10 at the lowering side. Furthermore, a contact 41 of the switch 4 for raising the antenna is connected to one end of a reversible motor 3, and a contact 51 of the switch 5 for lowering the antenna is connected to the other end of the motor 3 through a relay 6. A contact 44 of the switch 4 for raising the antenna and another contact 45 of the switch 5 for lowering the antenna, when not operated, are in contact with the contacts 43 and 53, respectively. The limit switch 9 at the raising side is turned off at a position of completion of raising of the antenna in accordance with a rotated position of the motor 3, and turned on in any position other than the above. Likewise, the limit switch 10 at the lowering side is turned off at a position of completion of lowering of the antenna and turned on at any position other than the above. Furthermore, a contact 21 of an ignition switch 2 is connected to the positive pole of the power source 1, a contact 22 contacting a contact 24 at an ACC position and an IG position, both of which are "on" positions, is connected to a coil 61 of a relay 6 through a diode 8, and a contact 23 contacting the contact 24 at an IG position and a ST position, both of which are "on" positions, is connected to the coil 61 of the relay 6 through a diode 7, respectively, and the coil 61 is further connected to the negative pole of the power source 1. A contact 62 of a switch 66 of the relay 6 is connected to the other end of the motor 3, a contact 63 to the limit switch 10, a contact 64 to the contact 51 of the switch 5 for lowering the antenna, respectively, a contact 65 contacts the contact 64 when the coil 61 is energized, and normally contacts the contact 63.

With the abovedescribed circuit arrangement, if the contact 24 of the ignition switch 2 is brought to the ACC, IG or ST position, each of which is an "on" position, the coil 61 of the relay 6 is energized, the contact 65 of the switch 66 is brought into contact with the contact 64, and thereafter, the switch 4 for raising the antenna is operated to bring the contact 44 in contact with the contact 42, then the motor 3 can be rotated in a direction of raising the antenna, and the motor 3 continues to rotate until the switch 4 for raising the antenna is stopped in operation or the antenna has been raised up to turn the limit switch 9 off. If the switch 5 for lowering the antenna is operated, then the antenna can be likewise lowered. Additionally, if the contact 24 of the ignition switch 2 is brought to an "off" position under a condition where the antenna is in the raised position and the limit switch 10 is on, then the coil 61 of the relay 6 is deenergized, whereby the contact 65 contacts the contact 63 and the motor 3 is rotated in a direction of lowering the antenna regardless of operation of the switch 5 for lowering the antenna. When the limit switch 10 is turned off upon completion of lowering the antenna, the motor 3 is stopped in rotation.

The desired requirements are satisfied by the circuit shown in FIG. 1, however, while the ignition switch 2 is brought to the "on" position, the current continuously passes through the coil 61 of the relay 6. This current is of about 150 mA and is insignificant in value during rotation of the engine, i.e., power generation by a generator. However, such a disadvantage is presented that the vehicle-mounted power source 1, i.e., a battery may be overdischarged when the engine is stopped in operation. In short, this disadvantage is resulted from the fact that when an occupant of the vehicle brings the contact 24 of the ignition switch 2 to the ACC position to stop the engine in operation, and thereafter, listens in a vehicle-mounted radio, the current passes through the coil 61 of the relay 6 through the contact 22, whereby the discharge voltage from the battery increases.

SUMMARY OF THE INVENTION

The present invention has been developed in view of the abovedescribed disadvantage in the conventional circuit arrangement and has as its object the provision of a control circuit wherein the current is supplied to the relay coil only while the ignition switch is turned off to lower the antenna and the current is not fed to the relay coil while the antenna is not lowered.

To achieve the abovedescribed object, according to the present invention, a relay coil is connected to the power source through a transistor, which is adapted to be turned off when an ignition switch is turned on and to be turned on when the ignition switch is turned off, and a limit switch at the lowering side, and a relay switch for forming a circuit for lowering the antenna when the relay coil is energized is connected to a motor circuit, whereby the current is supplied to the relay coil only for the period of time from the turn-off of the ignition switch to the completion of lowering of the antenna, thereby enabling to reduce the electricity consumption rate.

BRIEF DESCRIPTION OF THE DRAWINGS

The abovementioned features and object of the present invention will become more apparent by reference to the following description taken in conjunction with the accompanying drawings, wherein like referenced numerals denote like elements, and in which.

DETAILED DESCRIPTION OF THE INVENTION

Figure 2:
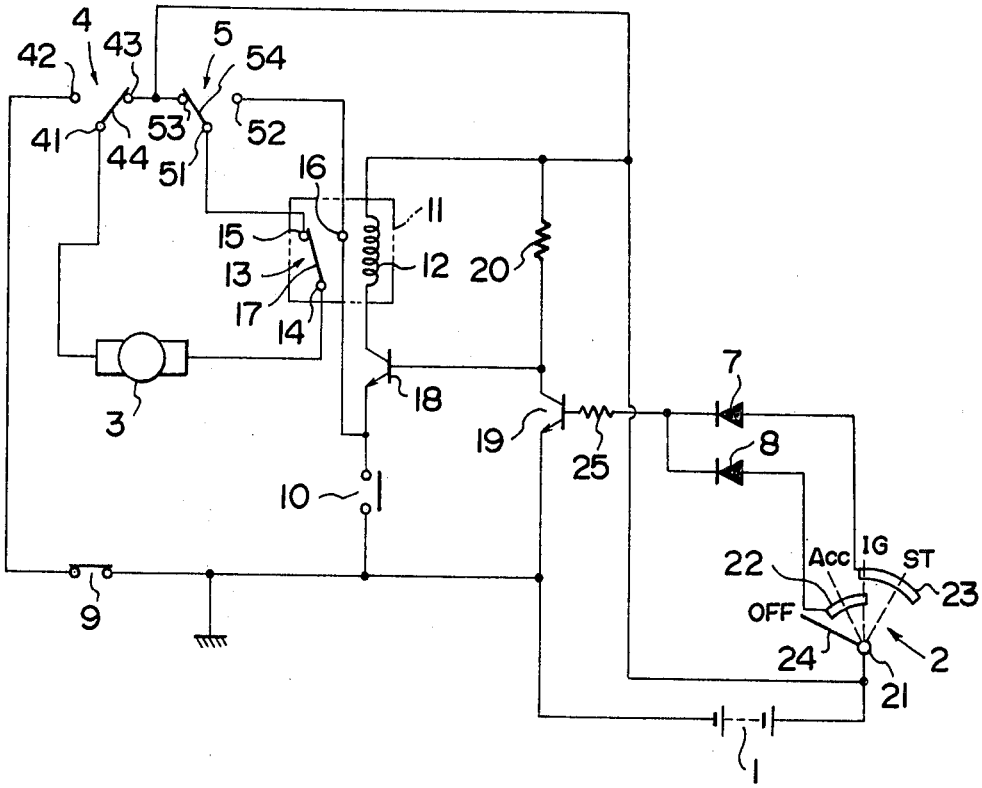
FIG. 2 is an electric circuit diagram showing an embodiment of the present invention.

Description will hereunder be given of the embodiment of the present invention shown in FIG. 2.

Figure 1:
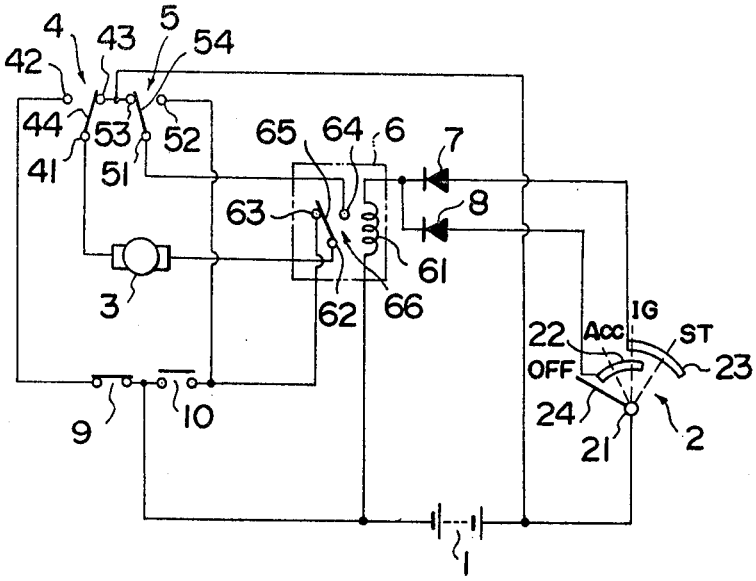
FIG. 1 is an electric circuit diagram showing an example of the pole antenna control circuit for a vehicle of the prior art.

In addition, the circuit arrangement in FIG. 2 is substantially identical with that in FIG. 1 except for the circuit between the ignition switch and the relay, and hence, same reference numerals as shown in FIG. 1 are used to designate same or similar elements in FIG. 2, so that detailed description will be omitted.

The contacts 22 and 23 of the ignition switch 2 are connected to a base of an NPN type transistor 19 through diodes 8 and 7, respectively and a resistor 25. A collector of the transistor 19 is connected to the positive pole of the power source 1 through a resistor 20 and also connected to a base of an NPN type transistor 18. Furthermore an emitter of the transistor 19 is connected to the negative pole of the power source 1, a collector of the transistor 18 to one end of a coil 12 of a relay 11, and an emitter of the transistor 18 to the negative pole of the power source 1 through the limit switch 10 at the lowering side, respectively. The relay 11 is of such an arrangement that the other end of the coil 12 is connected to the positive pole of the power source 1, the contact 14 of the switch 13 to the motor 3, the contact 15 to the contact 51 of the switch 5, and the contact 16 to the contact 52 of the switch 5 and the limit switch 10, respectively, whereby a contact 17 contacts a contact 16, when the coil 12 is energized, and normally the contact 17 contacts.

Description will now be given of operation of the embodiment shown in FIG. 2. When the contact 24 of the ignition switch 2 is brought to the ACC, IG or ST position, which is the "on" position, the power source 1 supplies the current to the base of the transistor 19 through the diodes 7, 8 and the resistor 25 to turn the transistor 19 on. Then, the base potential of the transistor 18 is lowered to less than the threshold level to turn the transistor 18 off. Consequently, no current is supplied to the relay coil 12, whereby the contact 17 remains in contact with the contact 15. When the switch 4 for raising the antenna in this condition to bring the contact 44 into contact with the contact 42, the current from the power source 1 passes through a circuit including the switch 5 for lowering the antenna, the relay switch 13, the motor 3, the switch 4 and the limit switch 9, whereby the motor 3 is rotated in the direction of raising the antenna. At this time, if the operation of the switch 4 for raising the antenna is discontinued or the raising of the antenna is completed to turn the limit switch 9 off, the abovedescribed current circuit is opened, whereby the motor 3 is stopped at this position.

If the operation of the switch 4 for raising the antenna is discontinued and the switch 5 for lowering the antenna is operated to bring the contact 54 into contact with the contact 52 in the condition where the antenna is raised up, the current is passed through a circuit including the power source 1, the switch 4 for raising the antenna, the motor 3, the relay switch 13, the switch 5, a contact 16 of the relay 11 and the limit switch 10, whereby the motor 3 is rotated in the direction of lowering the antenna. At this time, if the operation of the switch 5 for lowering the antenna is discontinued or the lowering of the antenna is completed to turn the limit switch 10 off, then the abovedescribed current circuit is opened, whereby the motor 3 is stopped at that position.

Subsequently, if the operation of the switch 4 for raising the antenna is discontinued and the contact 24 of the ignition switch 2 is brought to the "off" position, the current is interrupted to be supplied to the base of the transistor 19 through the diodes 7, 8 and the resistor 25 to turn the transistor 19 off. Then, the base potential of the transistor 18 is elevated to cause the power source 1 to supply the base current thereto through the resistor 20, whereby the transistor 18 is turned on, so that the coil 12 of the relay 11 can be energized. Consequently, the contact 17 of the relay switch 13 is operated to contact the contact 16. As a result, the current is passed through the circuit including the power source 1, the switch 4 for raising the antenna, the motor 3, the contact 17 of the relay switch 13, the contact 16 and the limit switch 10, whereby the motor 3 is rotated in the direction of lowering the antenna. When the lowering of the antenna is completed to turn the limit switch off, the abovedescribed current circuit is opened to stop the motor 3 in operation.

As apparent from the foregoing description of operation, in the circuit according to the invention, when the contact 24 of the ignition switch 2 is at the ACC, IG or ST position, each of which is the "on" position, the transistor 19 is turned on and the transistor 18 off, whereby no current is supplied to the relay coil 12. Whereas, the contacts 24 of the ignition switch 2 is at the "on" position, the transistor 19 is turned off and the transistor 18 on. As a result, the current is supplied to the relay coil 12 only for the period of time from the start of lowering of the antenna to the completion of lowering of the antenna, i.e., turning off the limit switch 10. Consequently, even if the engine is stopped in operation and the contact 24 is brought to the ACC position of the ignition switch 2 for listening in the radio, i.e., into contact with the contact 22, no current is supplied to the relay coil 12, whereby the electricity consumption of the power source 1 is limited to a very small value of about 3 mA which is consumed by the transistor 19, thereby offering such an advantage as to prevent the battery, i.e., the power source from being overdischarged.

As described above, description has been given of one embodiment of the present invention, however, it should be understood that there is no intention to limit the invention to the specific form disclosed, but on the contrary, the invention is to cover various embodiments falling within the scope of the invention. For example, some are listed as follows:

(1) PNP type transistors can be also used as the transistors 18 and 19.

(2) The connecting position for the switch 5 for lowering the antenna can be exchanged with that for the relay switch 13.

As has been described hereinabove, according to the present invention, the relay coil is connected to the power source through the transistor adapted to be turned on at the "off" position of the ignition switch and the limit switch at the lowering side adapted to be turned off at the position of the completion of the lowering of the antenna, and the motor is rotated in the direction of lowering the antenna by the relay switch operated by the relay coil energized. Hence, such advantages can be offered that a very short period of time from the turning off of the ignition switch to the completion of lowering the antenna is required for supplying the current to the relay coil, the electricity consumption of the vehicle-mounted power source having a limited capacity can be saved, i.e., it becomes possible to listen in the radio with the engine stopped in operation, and moreover, the antenna can be automatically lowered to be housed in the vehicle body by turning the ignition switch off, so that the antenna can be prevented from being broken out of fun and can avoid being in the way of people or objects being therearound. Accordingly, the present invention is highly useful as the control circuit of the pole antenna used in the vehicle.

From the foregoing description, it should be apparent to one skilled in the art that the abovedescribed embodiment is but one of many possible specific embodiments which can represent the applications of the principles of the present invention. Numerous and varied other arrangements can be readily devised by those skilled in the art without departing from the spirit and scope of the invention.

What is claimed is:

1. A power antenna control circuit, comprising:

a reversible motor rotatable to raise or to lower an antenna;

a motor having at least two terminals;

a power source for said motor having at least two poles;

a first switching means which normally connects a first terminal of said motor to a first pole of said power source, said switching means being switchable to connect the first terminal of said motor to a second pole of said power source to raise said antenna;

a second switching means which normally connects a second terminal of said motor to the first pole of said power source, said second switching means being switchable to connect the second terminal of said motor to the second pole of said power source to lower said antenna;

a first limit switch between said first switching means and the second pole of said power source which is in the off position when the antenna is fully raised and in the on position when the antenna is at all other positions;

a second limit switch between said second switching means and the second pole of said power source which is turned off when the antenna is completely lowered and is turned on when said antenna is at all other positions;

a first transistor which is turned on when an ignition switch is turned on and which is turned off when the ignition switch is turned on;

a second transistor, the base of which is connected to the collector of said first transistor and the emitter of which is connected to the second limit switch for lowering the antenna, adapted to be turned on when said first transistor is turned off and turned off when said first transistor is turned on;

a relay coil connected at one end to said first pole of said power source and at the other end to said second pole of said power source through the collector and the emitter of said second transistor and said second limit switch; and a relay switch which normally connects said second switching means for lowering said antenna to the second terminal of said motor and, when energized by said relay coil, connects the second terminal of said motor to the second pole of said power source by bypassing said second switching means for lowering the antenna.

2. A power antenna control circuit in accordance with claim 1, wherein said first transistor is an NPN type transistor.

3. A power antenna control circuit in accordance with claim 1, wherein said second transistor is an NPN type transistor.

4. A power antenna control circuit in accordance with claim 1, wherein said first transistor is a PNP type transistor.

5. A power antenna control circuit in accordance with claim 1, wherein said second transistor is a PNP type transistor.

* * * * *